US007314392B2

(12) United States Patent
Pharn et al.

(10) Patent No.: US 7,314,392 B2
(45) Date of Patent: Jan. 1, 2008

(54) SYSTEM AND METHOD FOR DETECTING AN INCORRECT CABLE CONNECTION

(75) Inventors: Art Pharn, Huntington Beach, CA (US); James M. Muth, Santa Ana, CA (US); Ross Nagarasan, Orange, CA (US); Richard M. Togashi, Rancho Santa Margarita, CA (US)

(73) Assignee: Broadcom Corporation, Irvine, CA (US)

( * ) Notice: Subject to any disclaimer, the term of this patent is extended or adjusted under 35 U.S.C. 154(b) by 0 days.

(21) Appl. No.: 11/106,517

(22) Filed: Apr. 15, 2005

(65) Prior Publication Data

US 2006/0234564 A1 Oct. 19, 2006

(51) Int. Cl.
*H01R 24/00* (2006.01)

(52) U.S. Cl. ..... 439/676; 439/489

(58) Field of Classification Search ..... 439/489, 439/676, 188, 955, 490
See application file for complete search history.

(56) References Cited

U.S. PATENT DOCUMENTS

| | | | | |
|---|---|---|---|---|
| 5,772,466 | A * | 6/1998 | Morin et al. | 439/489 |
| 6,095,851 | A * | 8/2000 | Laity et al. | 439/490 |
| 6,890,197 | B2 * | 5/2005 | Liebenow | 439/188 |
| 2004/0132346 | A1 | 7/2004 | Sato et al. | 439/676 |
| 2004/0198099 | A1 | 10/2004 | Xue | 439/676 |
| 2004/0224565 | A1 | 11/2004 | Wan et al. | 439/680 |
| 2004/0235358 | A1 | 11/2004 | Wan et al. | 439/676 |

* cited by examiner

*Primary Examiner*—Javaid H. Nasri
(74) *Attorney, Agent, or Firm*—Sterne, Kessler, Goldstein & Fox PLLC

(57) ABSTRACT

A connector device (for example, a jack) is provided with a sensing mechanism that detects mating of another connector to the connector device, and differentiates between matching and non-matching connectors. The sensing mechanism generates a signal to indicate that a non-matching connector has been mated with the connector device.

15 Claims, 4 Drawing Sheets

SYSTEM AND METHOD FOR DETECTING AN INCORRECT CABLE CONNECTION

BACKGROUND OF THE INVENTION

1. Field of the Invention

The disclosed invention relates, for example, to systems and methods for determining when an inappropriate connector is mated to another connector such as a connecting jack.

2. Background Art

Certain modular connectors, such as conventional RJ-11 and RJ-45 connectors, are constructed with similar physical characteristics but provide differing connection mechanisms. For example, conventional RJ-11 and RJ-45 connectors are similar in shape but have a different maximum number of conductors and are typically used for different purposes. The RJ-45 connector supports up to eight conductors and is typically used in computer, router, switch, printer, and game console connections. The RJ-11 connector is typically used in telephonic, digital video recorder, and video set-top box applications, and supports up to six conductors. Frequently, only two or four conductors are implemented in an RJ-11-based connection.

Figure 1:
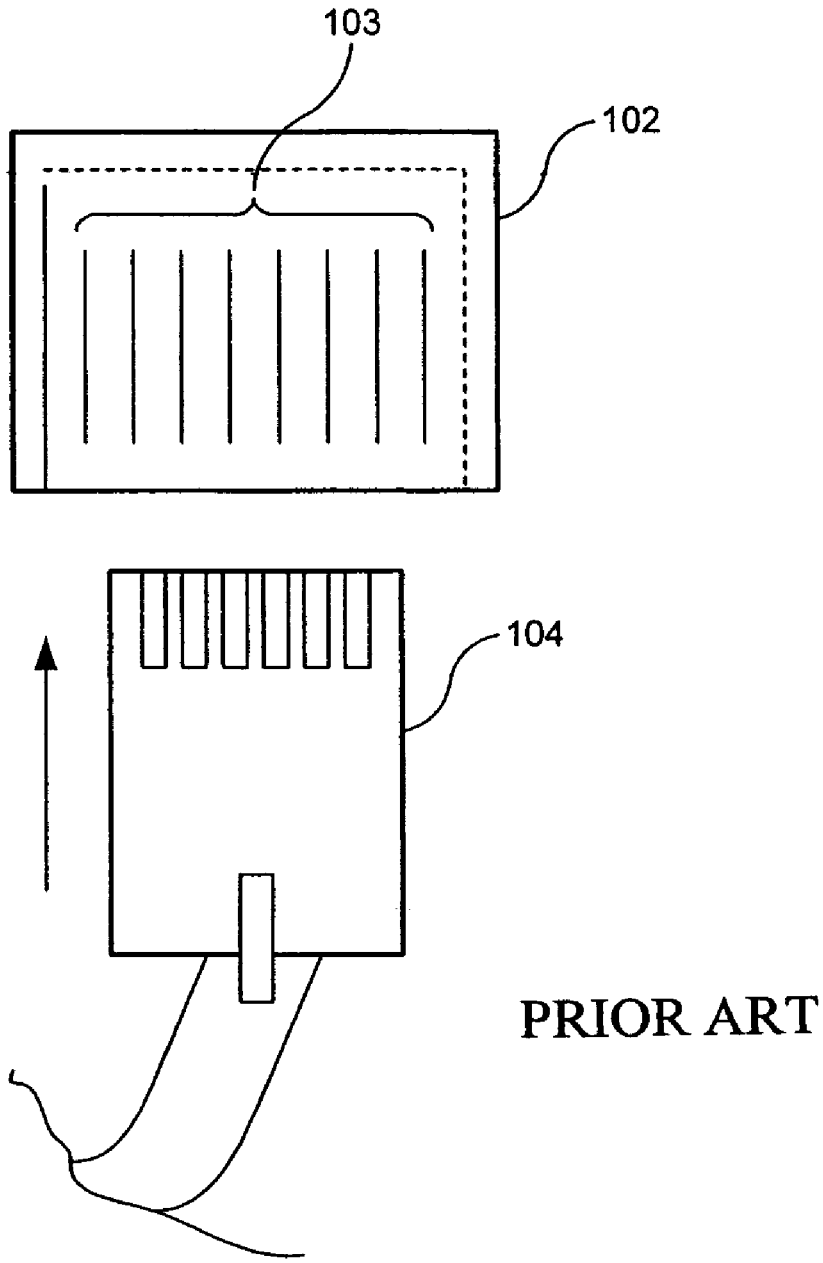

While a male RJ-45 connector is wider than an RJ-11 jack and cannot be plugged in to such a jack, the male RJ-11 connector (and other similar, smaller connectors) can be plugged into an RJ-45 jack. In many cases, end users assume that if the end of a cable fits into a jack, it is the right cable for the job. That assumption is inaccurate, for example, as illustrated in FIG. 1, if the user plugs a telephone cable with an RJ-11 connector 104 into an RJ-45 jack 102 with contacts 103 that is intended to connect with a CAT-5 Ethernet cable. In addition to inoperability and attendant frustration for the user, results of an incorrect connection may include unnecessary calls for technical support or on-site service, products needlessly returned to the store or the manufacturer, as well as possible damage to the connected devices. These problems occur in a variety of contexts, and are particularly prevalent in the case of consumer products where users may be less technically adept.

Therefore, what is needed is an improved system and method for detecting incorrect connections and providing an indication when the wrong connector has been mated with a device.

BRIEF SUMMARY OF THE INVENTION

In a preferred embodiment, a connector device (for example, a jack) is provided with a sensing mechanism that detects mating of another connector to the connector device, and differentiates between matching and non-matching connectors. The sensing mechanism generates a signal to indicate that a non-matching connector has been mated with the connector device.

BRIEF DESCRIPTION OF THE DRAWINGS/FIGURES

The accompanying drawings, which are included to provide a further understanding of the invention and are incorporated in and constitute a part of this specification, illustrate embodiments of the invention and together with the description serve to explain the principles of the invention. In the drawings, like reference numbers may indicate identical or functionally similar elements. Additionally, the left-most digit(s) of a reference number may identify the drawing in which the reference number first appears.

FIG. 1 illustrates the insertion of an RJ-11 connector into a conventional RJ-45 jack.

Figure 2A:
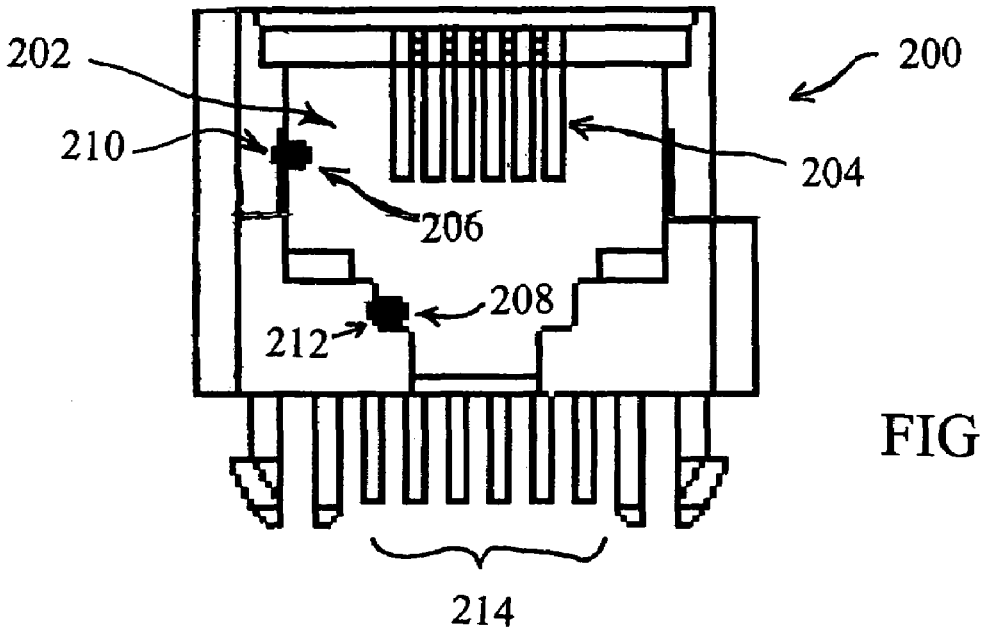
Figure 2B:
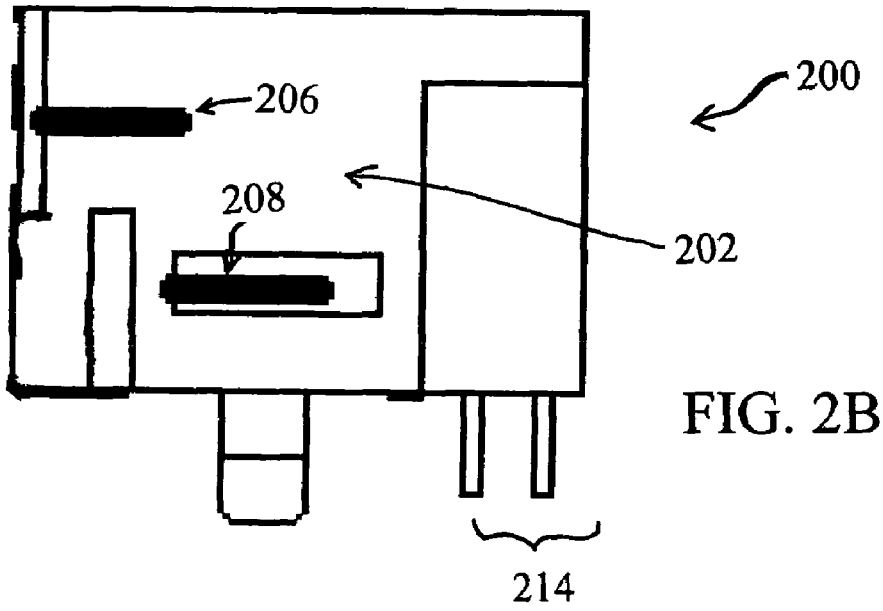
Figure 2C:
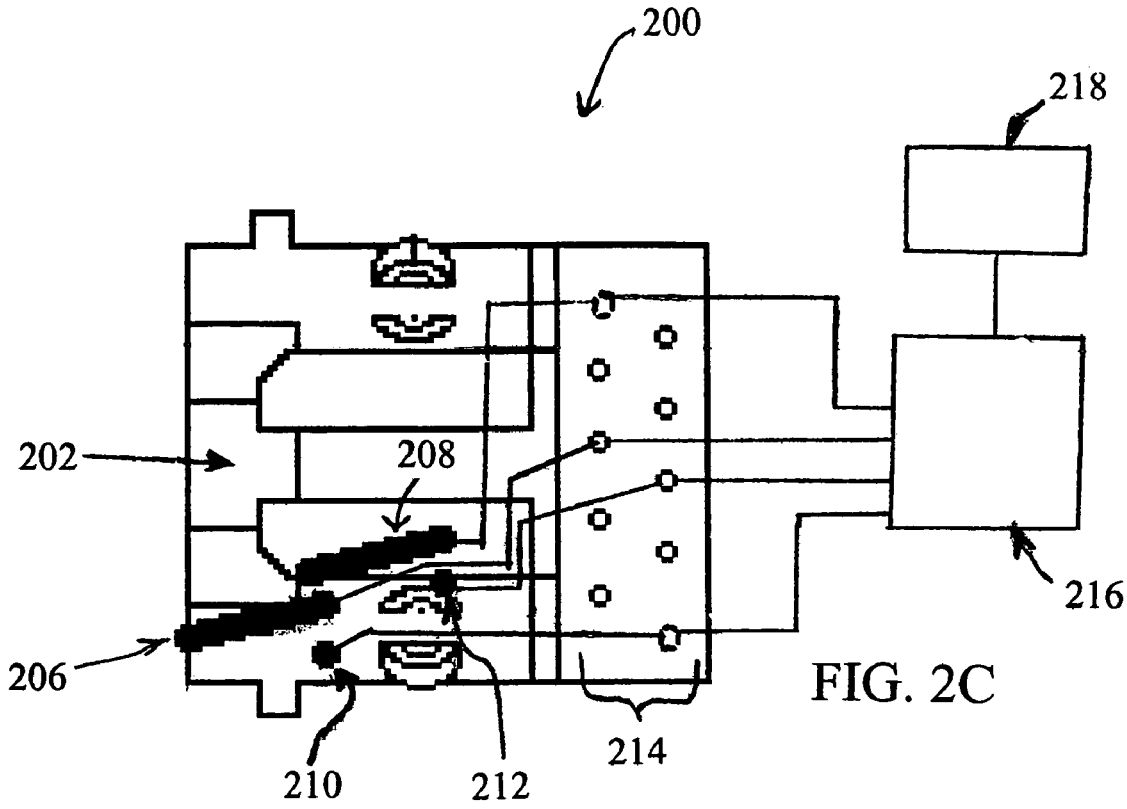

FIGS. 2A, 2B, and 2C are front, side, and bottom views respectively of an exemplary RJ-45 connector with insertion sensor devices installed.

Figure 3:
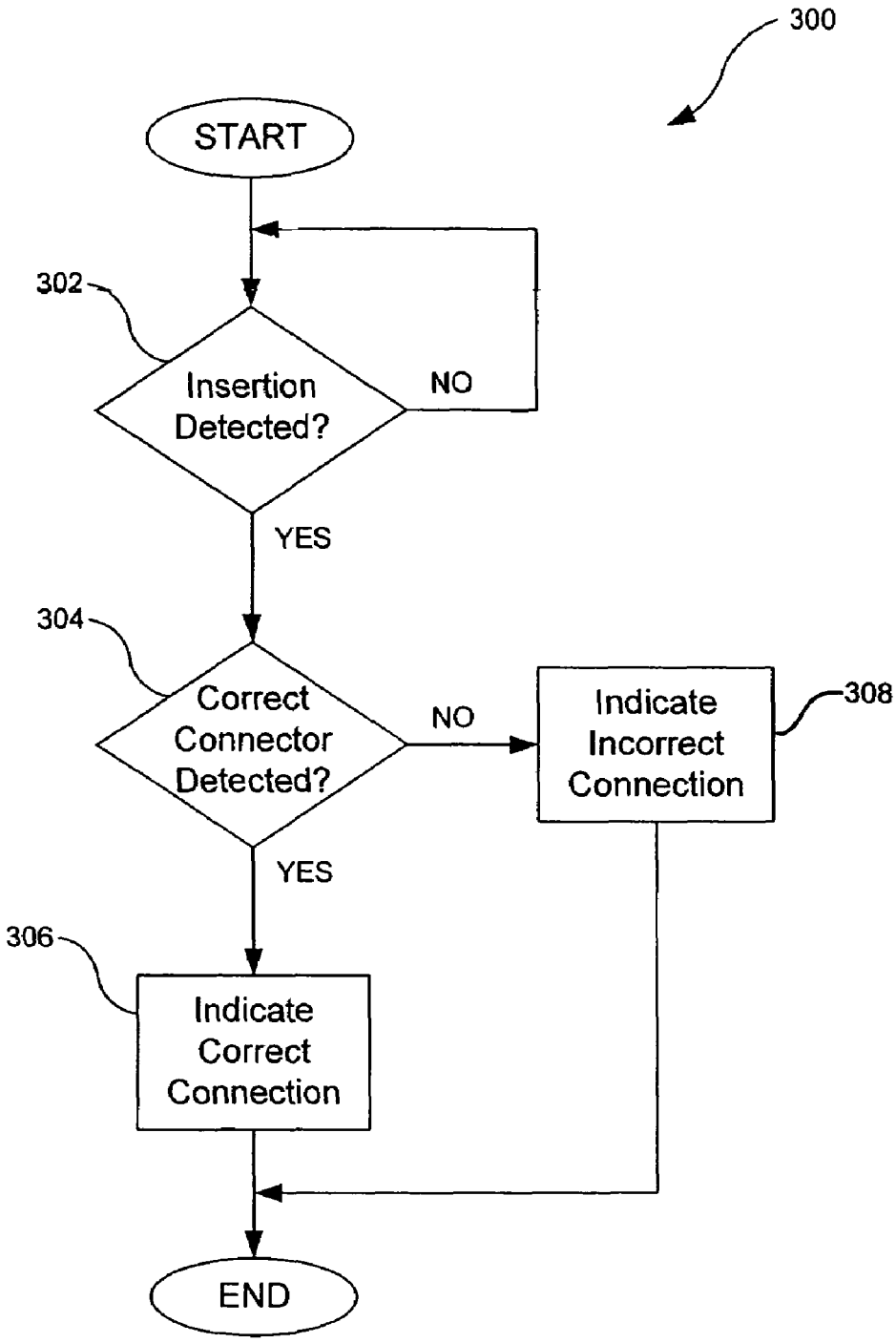

FIG. 3 is a flow chart showing an exemplary embodiment of a process for detecting and indicating an incorrect connection.

DETAILED DESCRIPTION OF THE INVENTION

While the present invention is described herein with reference to illustrative embodiments for particular applications, it should be understood that the invention is not limited thereto. Those skilled in the art with access to the teachings provided herein will recognize additional modifications, applications, and embodiments within the scope thereof and additional fields in which the invention would be of significant utility.

In FIGS. 2A, 2B, and 2C, a modular jack 200 is shown generally in three plan views including a front view (FIG. 2A), a side view (FIG. 2B) and a bottom view (FIG. 2C). As shown in these drawing figures, modular jack 200 has a receptacle 202 that receives a compatible plug connector (not shown). Modular jack 200 also has contacts 204 that engage corresponding contacts on the plug connector, and contacts 214 connected to contacts 204. Contacts 214 provide signal connections between the contacts 204 of jack 200, and a circuit external to jack 200.

In an embodiment, the modular jack 200 is an RJ-45 jack and may typically have six or eight contacts 204 depending on the requirements of the circuit in which jack 200 is used. In the embodiment illustrated in FIGS. 2A, 2B, and 2C, jack 200 is configured for mounting on a circuit board and contacts 214 are connecting pins adapted to be inserted in holes formed in the circuit board, and connection by soldered connections to traces on a surface of the circuit board.

In the embodiment shown, modular jack 200 is provided with two spring contacts 206 and 208 located in receptacle 202. When pressure is applied to spring contacts 206 and 208 they are forced into contact with contacts 210 and 212 respectively. Spring contacts 206 and 208 and contacts 210 and 212 are preferably each connected to a contact external to modular jack 200, such as one of the contacts 214. In this manner, a sensing circuit 216 (shown in FIG. 2C) and optionally an associated indicating circuit 218 can be connected to spring contacts 206 and 208 and contacts 210 and 212. This external circuit can be used to detect closure of spring contacts 206 and 208 against contacts 210 and 212 respectively.

FIG. 2C shows sensing circuit 216 connected to selected pins of contacts 214. Those pins are connected respectively to spring contacts 206 and 208 and contacts 210 and 212. The pins in contacts 214 used for connections to spring contacts 206 and 208 and contacts 210 and 212 may be additional pins provided for this purpose, pins that are unused in the application for which jack 200 has been installed, such as pins 4 and 5 in an 10/100 Base-TX Ethernet application, or a combination of both unused and additional pins.

Referring again to FIG. 2A, spring contact 208 is located such that spring contact 208 will be forced against contact 212 if any mating connector (such as an RJ-11 or RJ-45 connector) is inserted into receptacle 202 of jack 200. In the exemplary embodiment shown, spring contact 208 is located near the center of receptacle 202 close to the location where a plastic clip on an inserted RJ-11 or RJ-45 connector locks into jack 200. Thus placed, spring contact 208 will be forced into electrical connection with contact 212 if any compatible connector is inserted into receptacle 202. As shown in FIG. 2C, sensing circuit 216 is used to detect continuity between spring contact 208 and contact 212. Detecting such continuity indicates that a connector of some type has been inserted into receptacle 202 of jack 200.

In contrast, spring contact 206 is located such that spring contact 206 will be forced against contact 210 only if an RJ-45 connector is inserted into receptacle 202 of jack 200. In the exemplary embodiment shown, spring contact 206 is located at the edge of receptacle 202 in a location where an RJ-45 connector would force spring contact 206 into electrical connection with contact 210, but a smaller RJ-11 connector inserted into jack 200 would not actuate spring contact 206. Thus placed, spring contact 206 will be forced into electrical connection with contact 210 only if an RJ-45 connector is inserted into receptacle 202. Sensing circuit 216 (shown in FIG. 2C) may be used to detect continuity between spring contact 206 and contact 210. Detecting such continuity indicates that an RJ-45 connector has been inserted into receptacle 202 of jack 200.

The placement of spring contact 206 and contact 210 depends on the configuration of the connector and the "correct" connection that is to be detected. Spring contact 206 and contact 210, or a functionally equivalent device, may be placed either in a position where they would be closed or opened when a correct connection is made. The logic of the sensing circuit connected to the contacts is then adjusted to produce the desired operation based on the position of spring contact 206.

In operation, in a typical embodiment, if sensing circuit 216 detects continuity between spring contact 206 and contact 210, an RJ-45 connector has been inserted. If, however, sensing circuit 216 detects continuity between spring contact 208 and contact 212, indicating the insertion of a connector, but does not detect continuity between spring contact 206 and contact 210, then an incorrect connector insertion may have occurred. If this condition continues for a predetermined time period, sensing circuit 216 actuates indicator 218 to indicate an incorrect connection.

It will be understood that in general terms, the combination of spring contact 206 and contact 210 form a first sensing device that senses the position of a connector mated with the connector on which they are installed. Similarly, the combination of spring contact 208 and contact 212 form a second sensing device that senses the position of a connector mated with the connector on which they are installed. While these sensing devices have been disclosed as simple spring contacts, the sensing devices are not limited to this example and may include any switch or switch-like device, proximity sensor, or other presence sensing device, using any desired technology whether presently known or unknown.

Indicator 218 may be any audible, visual, tactile, or other indicator that can be interpreted by a human or machine, as appropriate to the application. As one example, in many Ethernet interfaces one or more light emitting diodes (LEDs) are provided to indicate link and activity status. Indicator circuit 218 may be configured to generate an error signal by controlling these existing LEDs in a predetermined manner, such as by flashing both the link and activity lights either simultaneously or with an alternating flash pattern. In another embodiment, the indicator may include generating a signal to another circuit or system, for example a computer or game console. Software or firmware in any connected device may receive the generated error signal and produce a display of an error indication, instructions, and/or other information on a screen or display associated with the device. For example, a computer or game console may display a specific error message indicating that the wrong cable has been connected in response to a generated error indicator signal.

The invention is not limited to the configuration shown and described in these embodiments, which are merely exemplary of a variety of possible configurations. For example, the invention is not limited to detecting incorrect insertions of RJ-11 connectors into RJ-45 jacks, but is applicable to any situation wherein more than one standard connector will fit into a given jack. In addition, the invention is not limited to jacks or to the particular design or configuration of jack shown in the drawings, or to devices designed for installation on circuit boards. The invention may be applied to any connecting device, regardless of whether it has a jack configuration or whether it is male or female. That is, the principles disclosed may be applied to any type of connector, regardless of its configuration or how it is installed, if it is installed at all. Further, the invention is not limited to the positions and design of the sensing circuits and sensing devices, which may be any sensing devices that will operate effectively to detect an incorrect connection according to one or more of the principles and concepts disclosed herein. It should also be noted that while the mating of a smaller connector (such as an RJ-11) to a compatible but different connector has been described in the exemplary embodiments in terms of being an error, in some applications it is intended that such mismatched connections be made. In those applications, an error indication may be generated in response to switch positions that indicate, for example, that an RJ-45 connector has been mated to an RJ-45 jack.

FIG. 3 is a flow chart showing a novel method of detecting an incorrect connection. As shown in FIG. 3, process 300 starts generally at step 302 where an appropriate sensing system determines whether an insertion or mating of a connector has occurred. For example, this step may be implemented by detecting continuity between spring contact 208 and contact 212 as shown and described with reference to FIG. 2C. If no insertion or other connection has occurred, the process continues to wait for such an insertion or mating action. When a mating or insertion action does occur, control passes to step 304. In step 304, the process determines whether the inserted or otherwise mated connector is the correct connector. For example, this step may be implemented by detecting continuity between spring contact 206 and contact 210 as shown and described with reference to FIG. 2C. In embodiments where the correct connector does not actuate spring contact 206, the lack of continuity between spring contact 206 and contact 210 would indicate a correct connection.

If the correct connection has been made, control passes to step 306. In step 306, which is optional, a signal or indicator of any desired type may be provided to indicate a correct connection. If a correct connection has not been made, control passes to step 308. In step 308, which is optional but preferred, an indication of an incorrect connection is provided. The indication may be any audible, visual, tactile, or other indicator that can be interpreted by a human or machine, as appropriate to the application. As one example, in many Ethernet interfaces one or more light emitting diodes (LEDs) are provided to indicate link and activity status. An error signal may be generated by controlling these existing LEDs in a predetermined manner, such as by flashing both the link and activity lights either simultaneously or with an alternating flash pattern.

While various embodiments of the present invention have been described above, it should be understood that they have been presented by way of example, and not limitation. It will be apparent to persons skilled in the relevant art that various changes in form and detail can be made therein without departing from the spirit and scope of the invention.

The present invention has been described above with the aid of functional building blocks and method steps illustrating the performance of specified functions and relationships thereof. The boundaries of these functional building blocks and method steps have been arbitrarily defined herein for the convenience of the description. Alternate boundaries can be defined so long as the specified functions and relationships thereof are appropriately performed. Any such alternate boundaries are thus within the scope and spirit of the claimed invention. One skilled in the art will recognize that these functional building blocks can be implemented by discrete components, application specific integrated circuits, processors executing appropriate software and the like or any combination thereof. Thus, the breadth and scope of the present invention should not be limited by any of the above-described exemplary embodiments, but should be defined only in accordance with the following claims and their equivalents.

What is claimed is:

1. A connecting device, comprising:

a connector housing;

a first sensor associated with the housing for sensing a mating of a connector with the housing;

a second sensor associated with the housing for sensing a mating of a specific type of connector with the housing; and an indicating circuit connected to the first sensor and the second sensor that provides a first indication when the first sensor indicates that a connector has been mated with the housing and the second sensor indicates that the connector mated with the housing is not the specific type of connector, and a second indication when the first sensor indicates that a connector has been mated with the housing and the second sensor indicates that the connector mated with the housing is the specific type of connector;

wherein the first and second sensors each consist of a spring contact and a contact on an interior cavity of the housing that are forced into electrical connection by direct physical contact between the spring contact and a connector when mated with the housing.

2. The device of claim 1, wherein the indicating circuit is external to the housing.

3. The device of claim 2, wherein the contact and spring contact of each of the first and second sensors are connected to the indicating circuit through contacts on the exterior of the housing.

4. The device of claim 1, wherein the connecting device comprises an RJ-45 jack, the second sensor only senses a mating of an RJ-45 connector with the RJ-45 jack, and the indicating circuit provides a first indication only when a connector that is not an RJ-45 connector has been mated with the RJ-45 jack and a second indication only when an RJ-45 connector has been mated with the RJ-45 jack.

5. The device of claim 4, wherein the RJ-45 jack is installed in a circuit that conducts Ethernet communications through the RJ-45 jack.

6. The device of claim 1, wherein the indicating circuit includes means for providing visual indications using light emitting diodes associated with an external circuit in which the connecting device is installed.

7. A method, comprising:

providing a connecting device including two sensors, a first sensor that senses a mating of one or more types of connectors with the connecting device, and a second sensor that senses a mating of a specific class of connectors with the connecting device;

monitoring the first and second sensors to determine when a connector has been mated with the connecting device;

providing a first indication when a connector has mated with the connecting device and it is not one of the specific class of connectors; and providing a second indication when a connector has mated with the connecting device and it is one of the specific class of connectors;

wherein the step of providing a connecting device including two sensors consists of providing as the first sensor a first spring contact and a first contact on an interior cavity of the housing that are forced into electrical connection by direct physical contact between the first spring contact and the one or more types of connectors when mated with the connecting device, and as the second sensor a second spring contact and a second contact on the interior cavity of the housing that are forced into electrical connection by direct physical contact between the second spring contact and one of the specific class of connectors when mated with the connecting device.

8. The method of claim 7, wherein the step of monitoring the sensors includes operating an external circuit connected to each of the first and second sensors through contacts exterior to the connecting device.

9. The method of claim 7, wherein the step of providing the connecting device includes providing an RJ-45 jack, with the second sensor operating only to sense mating of an RJ-45 connector with the RJ-45 jack.

10. The method of claim 9, wherein the step of providing a first indication includes providing the first indication only when a connector that is not an RJ-45 connector has been mated with the RJ-45 jack, and the step of providing a second indication includes providing the second indication only when a connector that is an RJ-45 connector has been mated with the RJ-45 jack.

11. The method of claim 7, wherein the step of providing first and second indications includes controlling in a predetermined manner light emitting diodes associated with an external circuit in which the connecting device is installed.

12. A connecting device, comprising:

a connector housing;

a first sensing device positioned in the connector housing to form an electrical connection in response to mating of a connector with the connector housing;

a second sensing device positioned in the connector housing to form an electrical connection in response to mating of a specific type of connector with the connector housing; and an indicating circuit connected to the first sensing device and the second sensing device, and configured to generate a first indication if the first sensing device forms an electrical connection and the second sensing device does not form an electrical connection and a second indication if the first sensing device forms an electrical connection and the second sensing device forms an electrical connection;

wherein the first and second sensing devices each consist of a spring contact and a contact that are forced into electrical connection by direct physical contact between the spring contact and a connector mated with the connector housing.

13. The device of claim 12, wherein the connector housing includes an RJ-45 jack, the second sensing device creates an electrical connection between its spring contact and its contact only in response to mating of an RJ-45 connector with the RJ-45 jack, and the indicating circuit is configured to generate a first indication only when a connector that is not an RJ-45 connector is mated with the RJ-45 jack and a second indication only when an RJ-45 connector has been mated with the RJ-45 jack.

14. The device of claim 13, wherein the RJ-45 jack is installed in a circuit that conducts Ethernet communications through the RJ-45 jack.

15. The device of claim 12, wherein the indicating circuit includes means for providing visual indications using light emitting diodes associated with an external circuit in which the connecting device is installed.

* * * * *